US007114623B2

(12) United States Patent
Robinson

(10) Patent No.: US 7,114,623 B2
(45) Date of Patent: Oct. 3, 2006

(54) POINT OF PURCHASE DISPLAY WITH INTERCHANGEABLE PLACARDS

(76) Inventor: John Robinson, 111 Harrison St., Bloomfield, NJ (US) 07003

( * ) Notice: Subject to any disclaimer, the term of this patent is extended or adjusted under 35 U.S.C. 154(b) by 0 days.

(21) Appl. No.: 11/050,168

(22) Filed: Feb. 4, 2005

(65) Prior Publication Data

US 2006/0180560 A1 Aug. 17, 2006

(51) Int. Cl.
*A47F 5/08* (2006.01)

(52) U.S. Cl. ..... 211/87.01; 211/87.01; 211/85.26; 40/446; 40/606.03; 40/611.06

(58) Field of Classification Search ..... 211/87.01, 211/75, 119.003, 55, 85.26, 119.004, 113, 211/117, 118, 52, 10; 312/245; 40/446, 40/646.02, 654.01, 606.03, 611.06
See application file for complete search history.

(56) References Cited

U.S. PATENT DOCUMENTS 1,377,812 A * 5/1921 Dlugach ..... 40/586
1,578,778 A * 3/1926 Thornhill ..... 190/11
1,940,078 A * 12/1933 Cooper ..... 206/464
2,110,128 A * 3/1938 Kent ..... 312/276
2,122,910 A * 7/1938 Garfinkle ..... 40/750
2,588,050 A * 3/1952 Rutherford ..... 40/606.12
3,063,183 A * 11/1962 Long ..... 40/336
3,618,238 A * 11/1971 Willinger ..... 40/661
4,846,430 A * 7/1989 Ke ..... 248/215
4,918,848 A * 4/1990 Stein ..... 40/584
4,982,852 A * 1/1991 Johansen ..... 211/162
5,850,705 A * 12/1998 Groh ..... 40/124.2
6,092,672 A * 7/2000 Harris et al. ..... 211/11
6,126,125 A * 10/2000 Dalton ..... 248/205.2
6,467,613 B1 * 10/2002 Felsenthal ..... 206/213
2006/0043036 A1 * 3/2006 Robertson ..... 211/75

* cited by examiner

*Primary Examiner*—Richard E. Chilcot, Jr.
*Assistant Examiner*—Lindsay M. Maguire
(74) *Attorney, Agent, or Firm*—Donald R. Heiner, Esq.

(57) ABSTRACT

A point of purchase display and product holding carriage having an essentially horizontal portion attachable to a point of purchase counter and a vertical product or carriage portion extending approximately ninety (90) degrees from the horizontal portion and projecting downwardly and in front of the counter or display stand. The vertical product carrying carriage has a plurality of pockets for holding the product. The horizontal portion which attaches to and is secured to a counter top or point of purchase display stand has a channel or opening for receiving interchangeable placards which contains point of purchase graphics which can be seen since the unit is made of clear plastic. A rear panel of the vertically extending portion or carriage which carries and displays product also has graphic material which can be seen from the front of the product carrier since it is also of clear plastic.

4 Claims, 6 Drawing Sheets

POINT OF PURCHASE DISPLAY WITH INTERCHANGEABLE PLACARDS

BACKGROUND OF THE INVENTION

Field of the Invention

The present invention generally involves the field of technology pertaining to a point of purchase display stand having several pockets for receiving and holding the product to be displayed and sold to an end user.

Essentially, the display has a horizontal and vertical portion at approximately ninety (90) degrees to each other. The unit is essentially of a clear plastic to allow for a graphic display, interchangeable, on the horizontal portion and the rear panel of the vertical portion also comprises a graphic which can be seen from the front of the display and wherein the graphic behind the product of this vertical portion of the display unit is pressure sensitive to hold it in place.

The graphic carrying placard in the horizontal portion is slid into and out of the unit and held in place by a graphic channel.

It should be obvious that this placard therefore is easily interchangeable by sliding into and out of the channels on the underside of the horizontal portion by means of the channels on the underside of the unit.

Since the unit comprises clear plastic both the graphic placard in the channels in the underside of the horizontal unit and the rear panel of the vertical portion which holds the product to be displayed are readily seen.

SUMMARY OF THE INVENTION

According to the present invention there is provided a point of purchase display device, preferably of a clear plastic material for reasons to be made obvious below. The invention essentially comprises two (2) main components. One is a generally rectangular, but may be of other shape, clear plastic for mounting onto a flat horizontal surface such as a counter top or display stand. This generally flat, clear plastic generally rectangular shaped portion of the invention further comprises a pair of channels disposed on its underside with one channel on each end such that a graphic bearing device or placard can be received and held in place by these channels or rails such that the graphic material may be viewed from the top when the interchangeable graphic holding device or placard is inserted and this horizontal portion of the invention is secured in place on a counter or display stand. Two (2) of the corners of the horizontal portion further comprise double sided tape blocks whereby when tape is removed from these mounting blocks the horizontal piece may be placed on the counter or point of purchase display stand and the two (2) tape corners are pressed down to secure the invention in place.

Extending downwardly, in a vertical direction, from one edge of the horizontal panel, distant from the tape blocks, is a tray or product holding means usually, but not necessarily, comprising several separate compartments.

It should be obvious that each of the compartments may hold the same product or different product may be inserted into each separate compartment.

A rear panel of this vertical section has graphic material which may be seen from the front of the display device. This graphic, behind the displayed product, is held in place on the rear panel of the vertical section by means of pressure sensitive tape. This graphic may also be changed.

On the ends of each channel distant from the double sided tape blocks are bumpers to slightly elevate the horizontal unit above the flat counter top or display stand.

It is therefore an object of the present invention to provide a point of purchase display device.

It is another object of the invention to provide such a point of purchase display device, preferably made of a clear plastic material or any other clear material.

It is yet a further object of the invention to provide such a point of purchase display device wherein the under surface of a horizontal portion of the device has means for receiving interchangeable displays.

It is still a further object of the invention to provide such a point of purchase display device comprising means on an underside of a horizontal portion of the unit to allow the unit to be attached to a flat surface such as a point of purchase counter top or stand.

It is still a further object of the invention to provide such a point of purchase display device having a vertical portion approximately ninety degrees disposed from the horizontal portion comprising one or more pockets for holding product to be sold.

It is still a further object of the invention to provide such a point of purchase display device wherein the vertical portion attached to the horizontal portion is also of a clear plastic or other material comprising a front panel, two side panels and a back panel which is also of a clear plastic or other material.

It is still a further object of the invention to provide such a point of purchase display device wherein a graphic display may be attached by pressure sensitive means such that this graphic can be seen from the front of the unit.

These and other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

A point of purchase display device having essentially a horizontal and a vertical portion attached to each other at an angle of approximately ninety degrees made of clear plastic or other suitable materials whose purpose is to hold product to be sold at a point of purchase display counter or stand will now be described with reference to the drawings.

The fully assembled point of purchase display device is best seen in FIGS. 1, 2, 6 and 7 as number 10.

Figure 1:
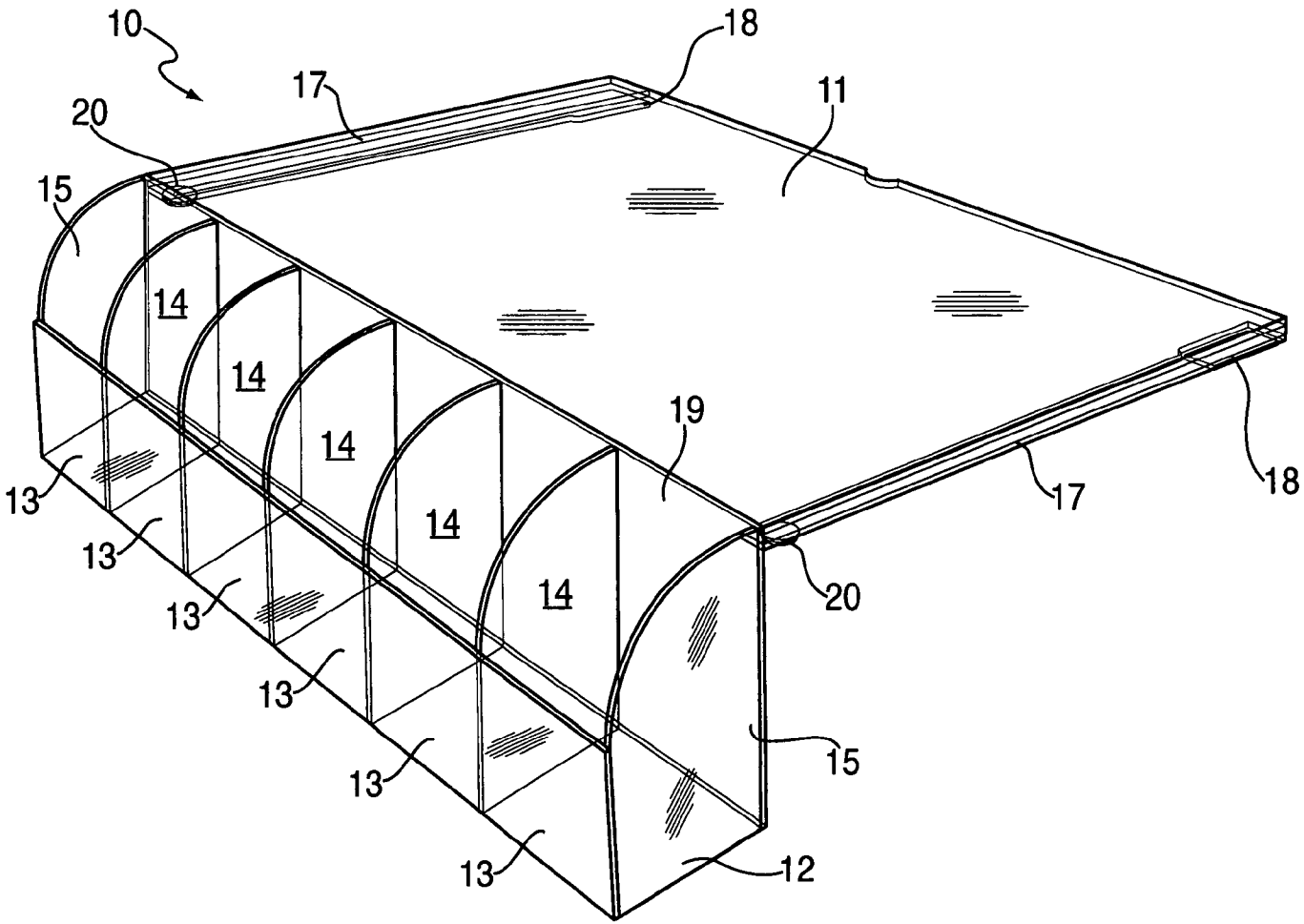
FIG. 1 is a top plan view showing the horizontal portion having channels on its underside to accommodate placards with point of purchase graphics and further showing a plurality of pockets on a vertical section for holding product.

FIG. 1 discloses the unit not attached to a counter or point of purchase display stand, having no graphics shown, and with the product holding compartments empty.

Figure 2:
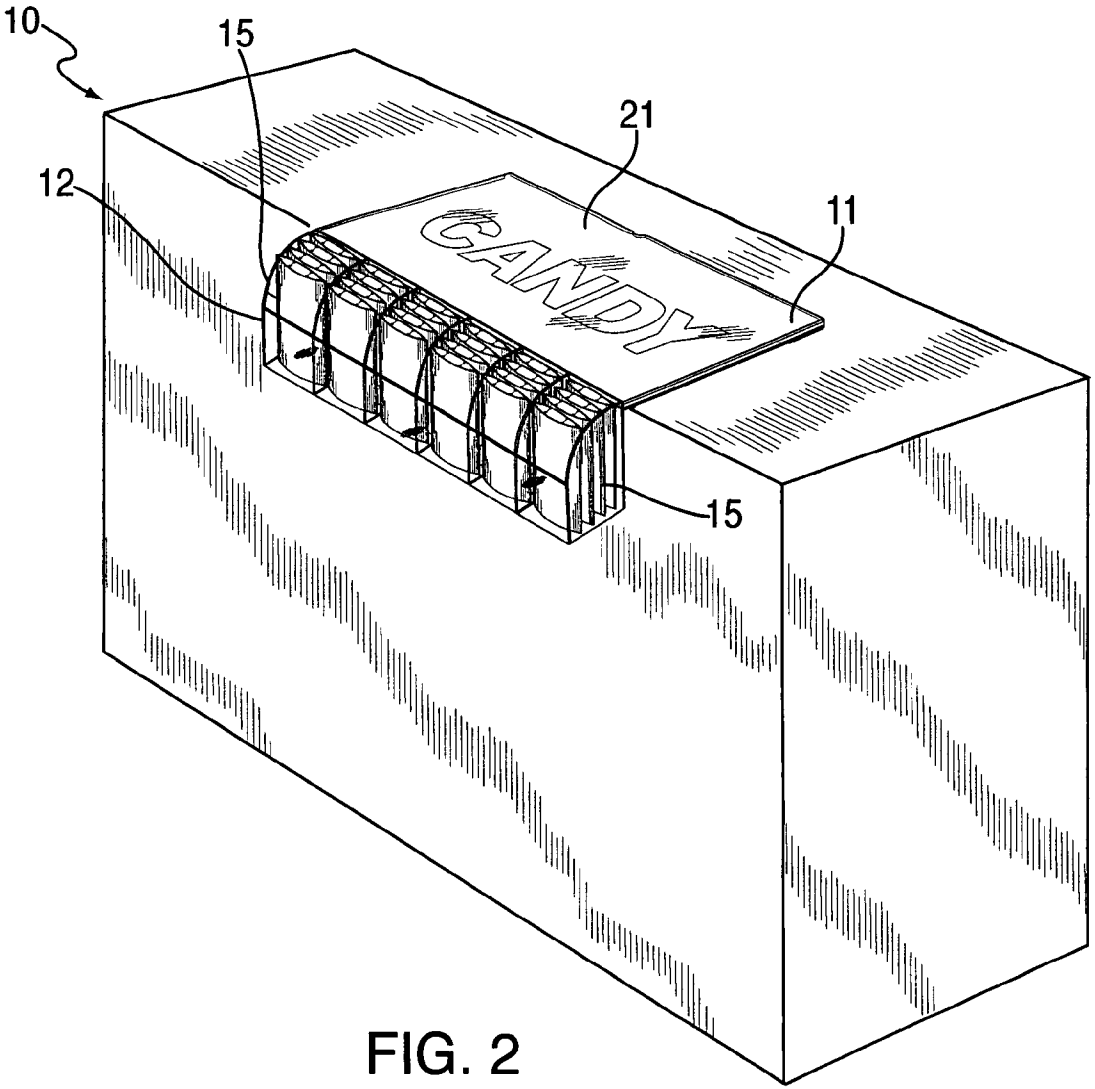
FIG. 2 shows the entire unit in place on a counter top.

FIG. 2 shows item 10 fully assembled and mounted to a counter top and showing a placard ("CANDY") and further showing the several compartments holding product.

Figure 6:
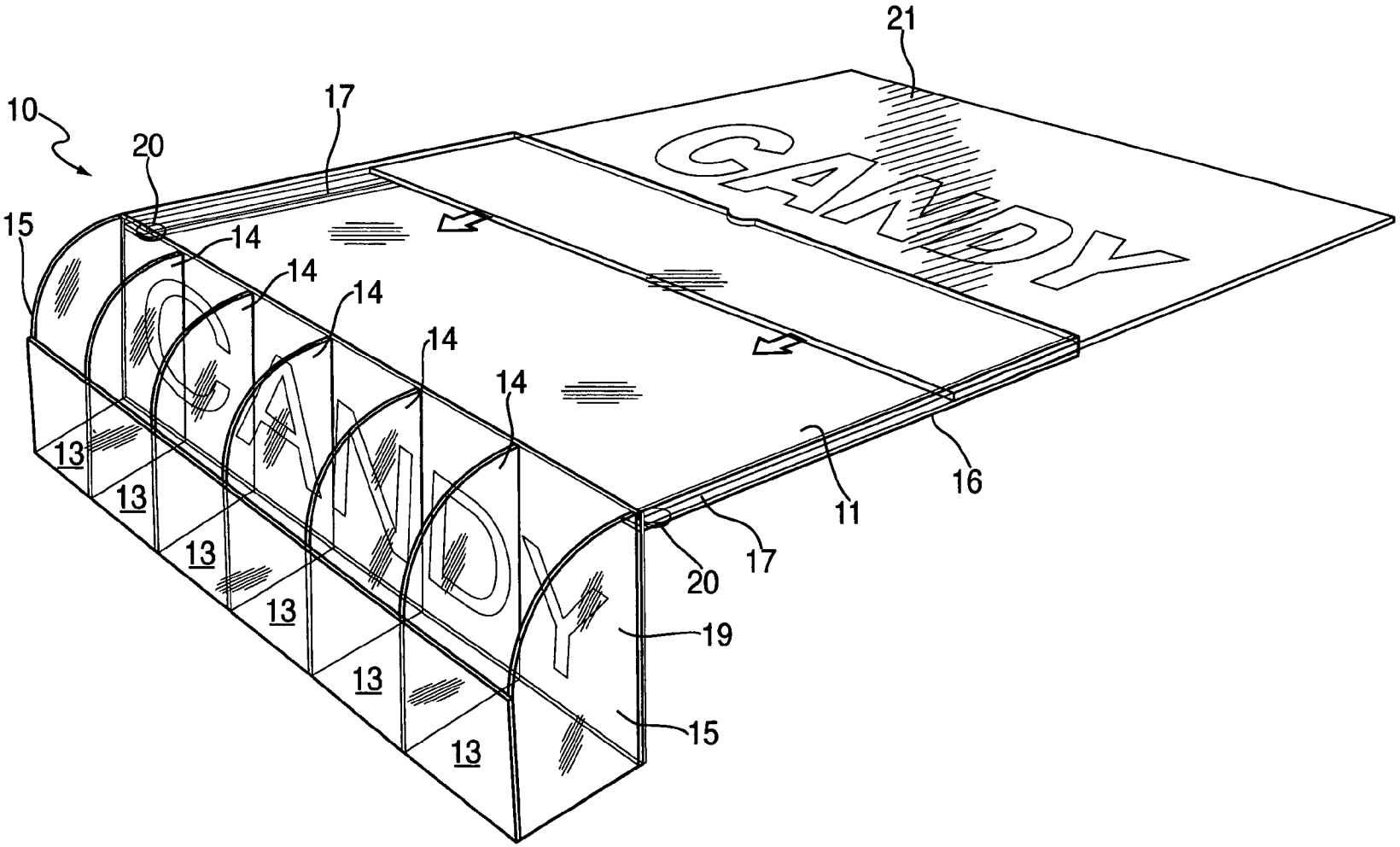
FIG. 6 is a pictorial view of the assembled device showing how the placards are inserted into the channels on the underside of the horizontal unit.
Figure 7:
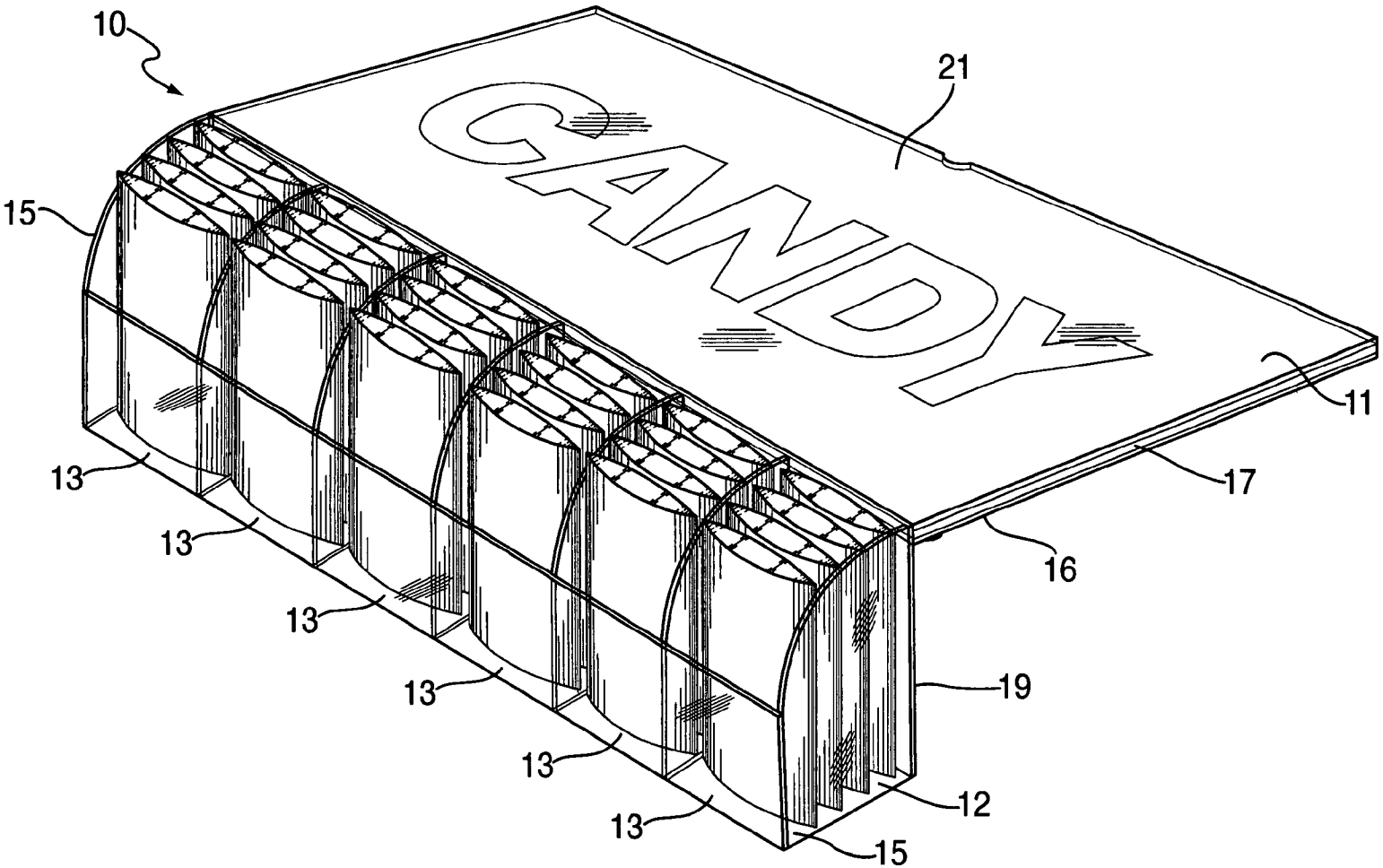
FIG. 7 is a pictorial view of the entire unit showing the point of purchase graphic placards in place and showing product disposed in each of the plurality of pockets.

FIG. 6 discloses item 10 having a graphic "CANDY" attached to a rear panel and further showing a placard "CANDY" partially inserted into channels on the underside of a horizontal portion of number 10 and FIG. 7 shows the entire unit number 10 having the placard fully inserted into the horizontal portion of the unit and further showing the pockets in the vertical portion of the unit filled with product.

As best seen in FIGS. 1, 6 and 7 the point of purchase display device 10 comprises a horizontal and a vertical portion at approximately a ninety degree angle. It should be understood that this angle can be more or less than the ninety degrees depending upon the display stand or counter top to which it is to be mounted. The horizontal portion is shown as item 11 and the vertical portion as item 12. Both item 11 and 12 are preferably made of a clear plastic material such that a graphic display mounted to either or both can be seen from the top and front of the unit.

A pocket or, preferably, a plurality of pockets 13 are associated with vertical portion 12 with the pockets being separated by partitions 14. This is best seen in FIGS. 1, 3, 6 and 7.

End units 15 keep the product from spilling out of the two end pockets.

The underside 16 of horizontal portion 11 has two (2) channels 17 spaced apart by the entire width of horizontal portion 11 and they extend the length or nearly the entire length of item 11 as readily seen in FIGS. 1, 3, 4, 6 and 7.

Figure 3:
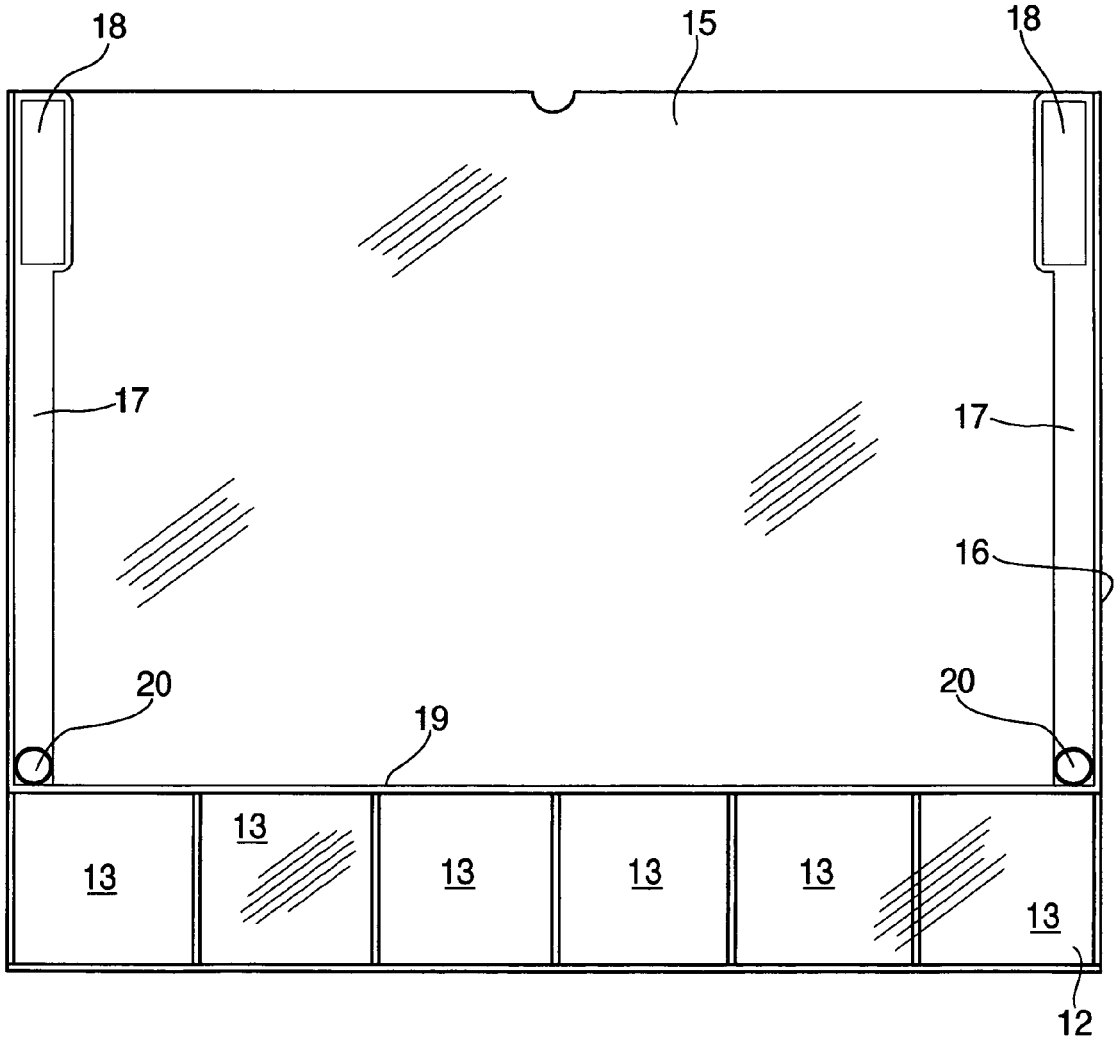
FIG. 3 is a top plan view again showing channels on the underside of the horizontal portion for accommodating placards with point of purchase graphics and which further shows double sided tape on each of two (2) corners and which further shows bumpers to slightly raise the unit above the counter top.
Figure 4:
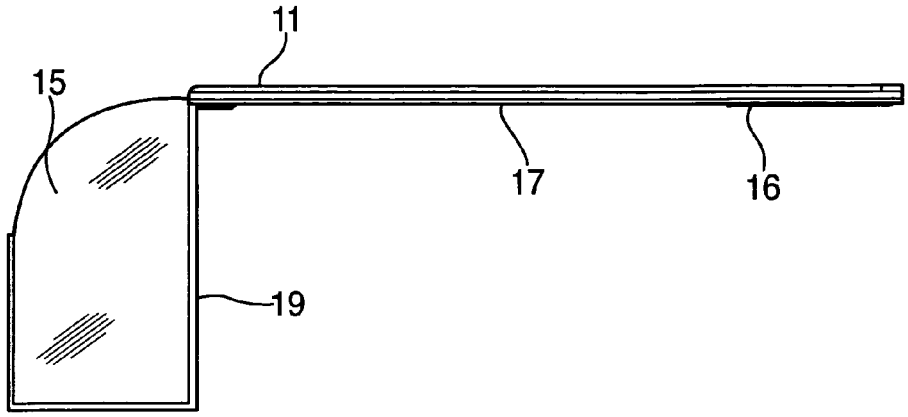
FIG. 4 is a side elevational view of the assembled unit showing the channels on the underside of the horizontal portion.
Figure 5:
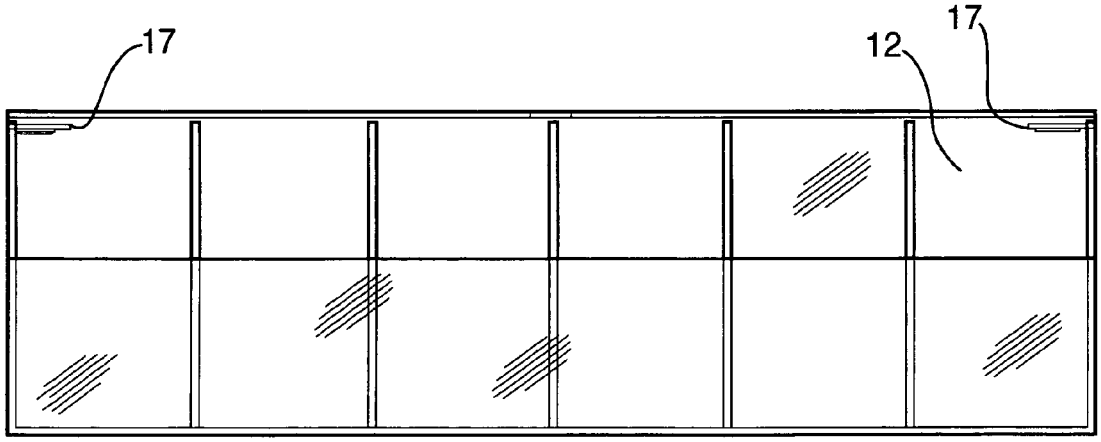
FIG. 5 is a front elevational view showing the plurality of pockets and further showing channels on the underside of the horizontal portion.

As readily seen in FIG. 3 double sided tape 18 are disposed at one end of each of channels 17 for the purpose of attaching horizontal portion 11 and therefore the point of purchase display device 10 to a counter top or display stand for the purpose of holding it in place.

Item 19 is the rear panel of the vertical portion of point of purchase display device 10. Item 19 is also of a clear or similar plastic material whereby a pressure sensitive graphic such as seen in FIG. 6 may be attached so that it may be seen by one standing in front of the display device 10. This is readily seen in FIGS. 1 and 6.

Small bumpers of plastic or other suitable material are attached to one end of each of channels 17 to slightly elevate the complete unit above a flat counter top to make the insertion and removal of placards easier. These bumpers 20 are on the end of channels 17 distant from double sided tape blocks 18.

As best seen in FIGS. 2, 6 and 7 a point of purchase placard 21 may be inserted into horizontal portion 11 by means of sliding the placard into channels 17 on the underside of horizontal portion 11 as best seen in FIGS. 6 and 7.

It should be obvious that the invention may be used without a graphic on the back panel and without placard 21 being inserted into item 11.

OPERATION OF THE INVENTION

Tape backing on the two (2) corners of the horizontal portion of the unit are peeled off. The horizontal portion of the unit is then placed on a flat counter top or point of purchase display stand with the vertical portion or product holding portion flush against a vertical wall. Pressure is then exerted on the double sided tape blocks to secure the unit in place.

The pockets or product holding compartments are then filled with product to be sold.

If desired, a graphic can be affixed behind the rear panel of the vertical unit by means of pressure sensitive material.

A graphic placard can then be inserted into the horizontal unit and held in place in the channels disposed on the underside of the clear plastic horizontal portion.

Though the invention has been described and illustrated with reference to a preferred embodiment thereof, those skilled in the art will appreciate that various changes and modifications in shape, size, composition and arrangement of parts may be resorted to without departing from the spirit of the invention or scope of the subjoined claims.

What is claimed is:

1. A point of purchase display for receiving and holding product to be viewed and sold wherein said display is attachable to a flat surface comprising:

(a) a generally rectangular shaped horizontal portion;

(b) a vertical portion attached to said horizontal portion at approximately ninety degrees and depending therefrom;

(c) a plurality of product holding pockets, including two end pockets, extending from said vertical portion;

(d) a plurality of partitions separating said pockets;

(e) an end unit attached at either end of said vertical portion to prevent product from spilling out of the two end pockets;

(f) an underside of said horizontal portion has two spaced apart channels extending the entire length thereof for receiving a placard; and (g) bumpers attached to one end of each of said channels nearest said vertical portion to elevate the point of purchase display when it is mounted on a flat counter top to facilitate the insertion and removal of said placards.

2. The point of purchase display of claim 1 wherein double sided tape blocks are disposed at one end of each of said channels distant from said bumpers for attaching said horizontal portion and therefore said point of purchase display to a flat surface.

3. The point of purchase display of claim 2 wherein a rear panel of said vertical portion receives a pressure sensitive graphic viewable in front of said point of purchase display.

4. The point of purchase display of claim 3 wherein said horizontal and said vertical portions are made of clear plastic.

* * * * *